US005916272A

United States Patent [19]

Nonnenmacher et al.

[11] Patent Number: 5,916,272

[45] Date of Patent: Jun. 29, 1999

[54] PROCESS FOR PRODUCING SLEEVED CLOTHING ARTICLES ON A TWO BED FLAT KNITTING MACHINE

[75] Inventors: Thomas Nonnenmacher, Pliezhausen; Henning Schmidt, Reutlingen; Juergen Schwenk, Hechingen; Achim Ulmer, Gomadingen, all of Germany

[73] Assignee: H.Stoll GmbH & Co., Reutlingen, Germany

[21] Appl. No.: 09/020,008

[22] Filed: Feb. 6, 1998

[30] Foreign Application Priority Data

Feb. 7, 1997 [DE] Germany ..... 197 04 646

[51] Int. Cl.[6] ..... D04B 7/00

[52] U.S. Cl. ..... 66/69; 66/176

[58] Field of Search ..... 66/60 R, 69, 70, 66/76, 96 R, 171, 175, 176, 189

[56] References Cited

U.S. PATENT DOCUMENTS 3,695,063 10/1972 Betts et al. ..... 66/176

3,796,068 3/1974 Betts et al. ..... 66/176

4,094,171 6/1978 Robinson ..... 66/176

FOREIGN PATENT DOCUMENTS 2183264 6/1987 United Kingdom ..... 66/176

*Primary Examiner*—Jeanette Chapman
*Assistant Examiner*—Larry D. Worrell, Jr.
*Attorney, Agent, or Firm*—Michael J. Striker

[57] ABSTRACT

Three variations of a process for interconnecting the sleeves and the torso portion of a sleeved clothing article during production of the sleeved clothing article on a two bed flat bed knitting machine include one variation of the process which provides sleeves having seam regions extending perpendicularly to the shoulders; another variation which provides sleeves having seam regions extending at an angle to the shoulders; and further variations which provides raglan sleeves.

3 Claims, 12 Drawing Sheets

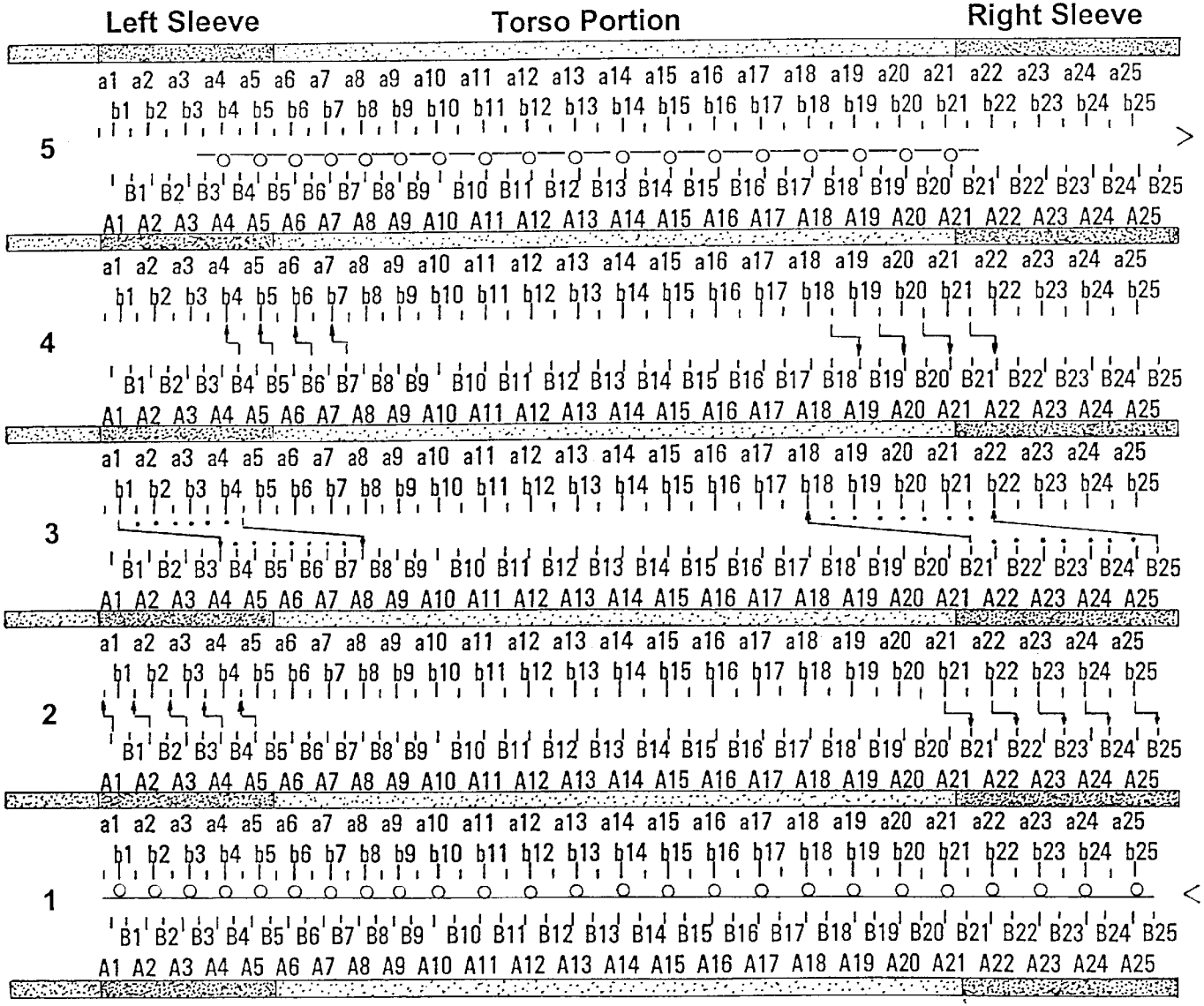
Fig. 2.1

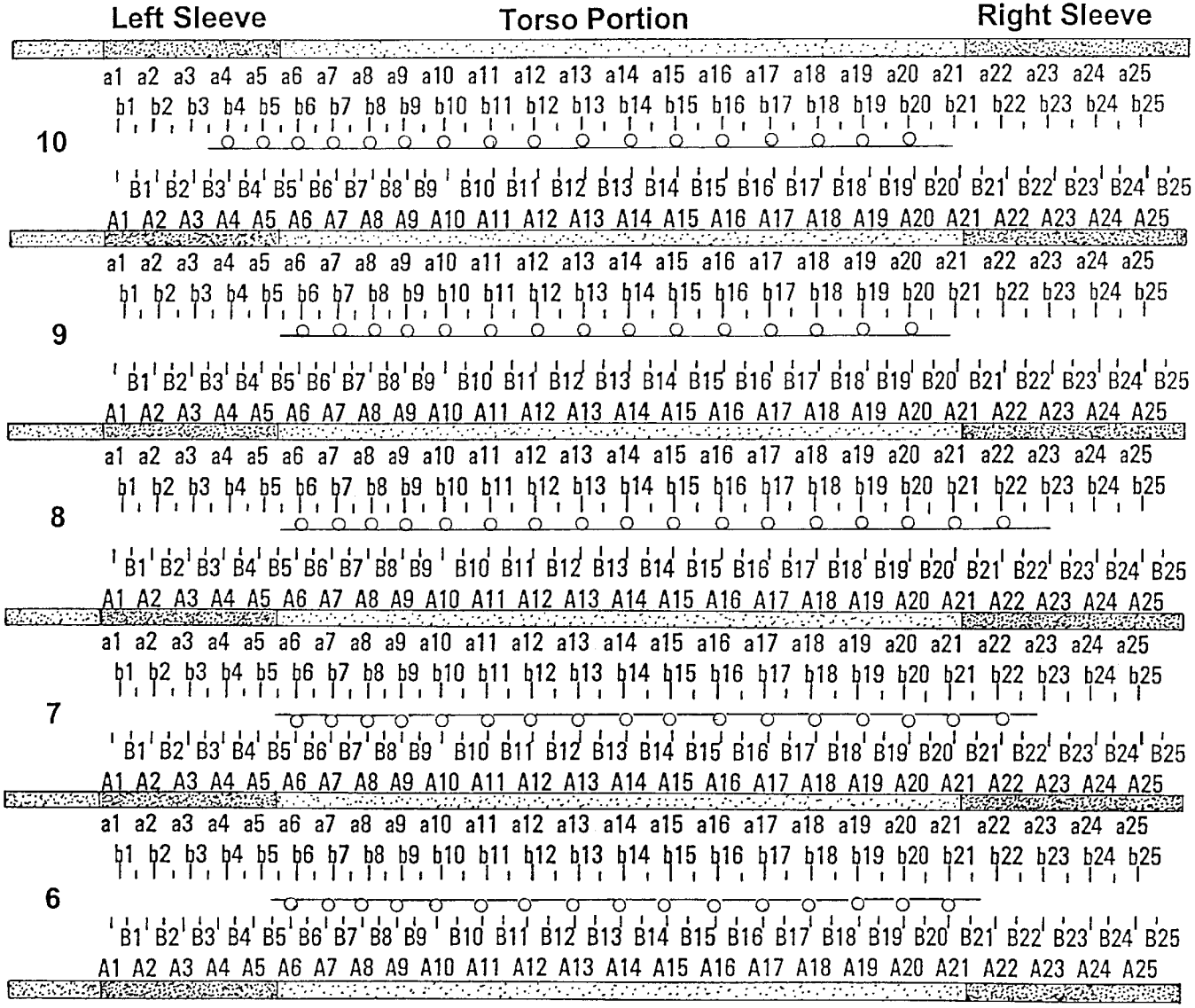
Fig. 2.2

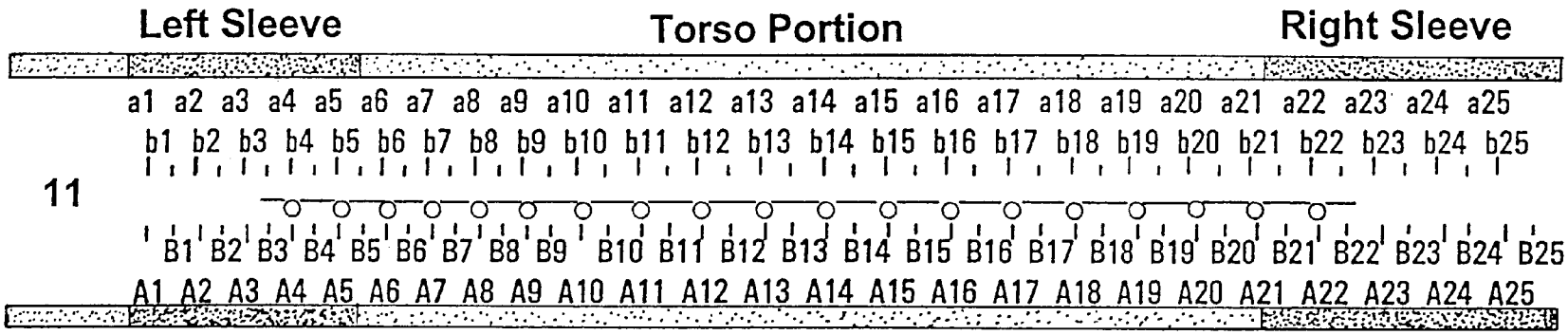
Fig. 2.3

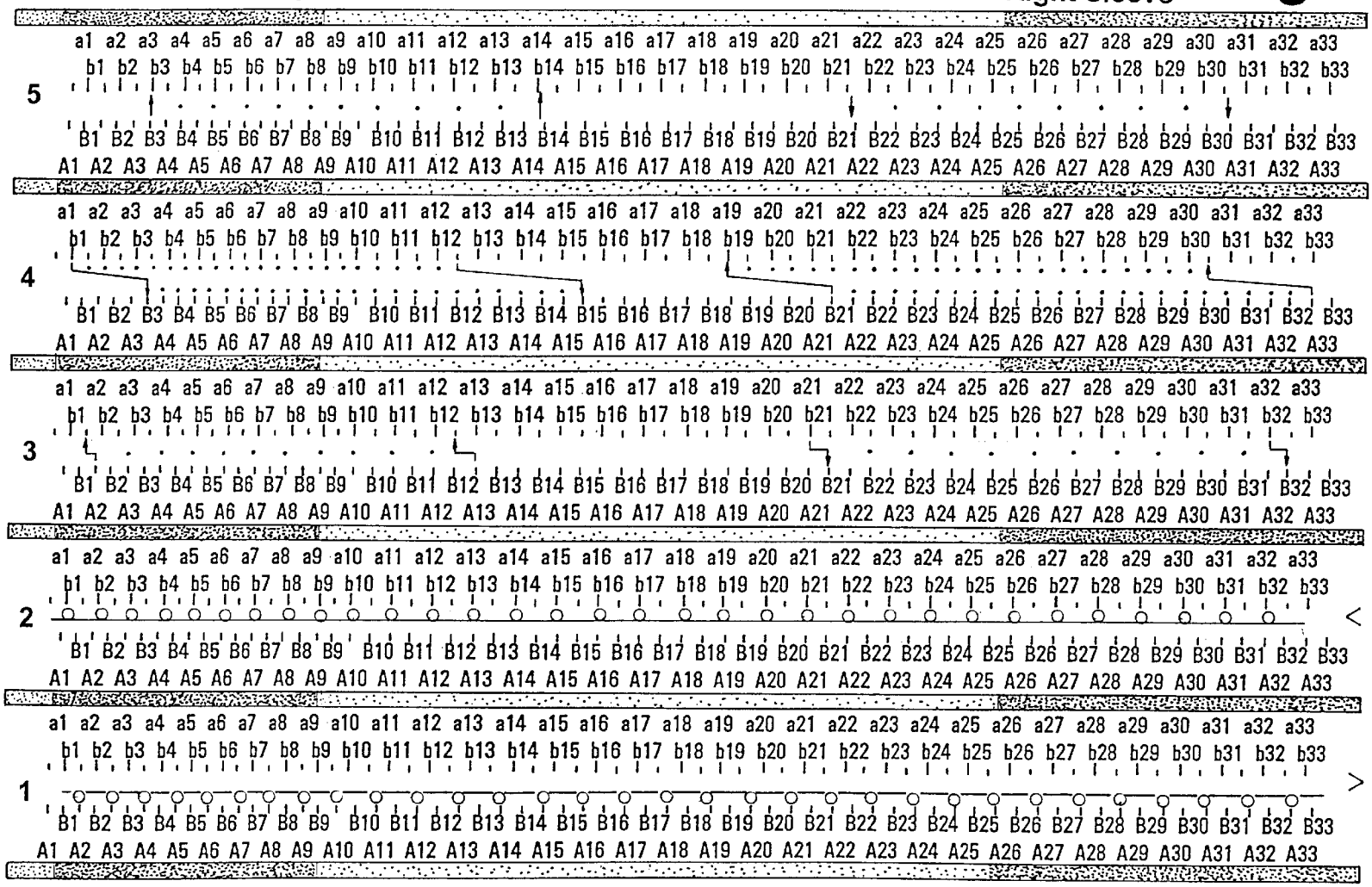
Fig. 4.1

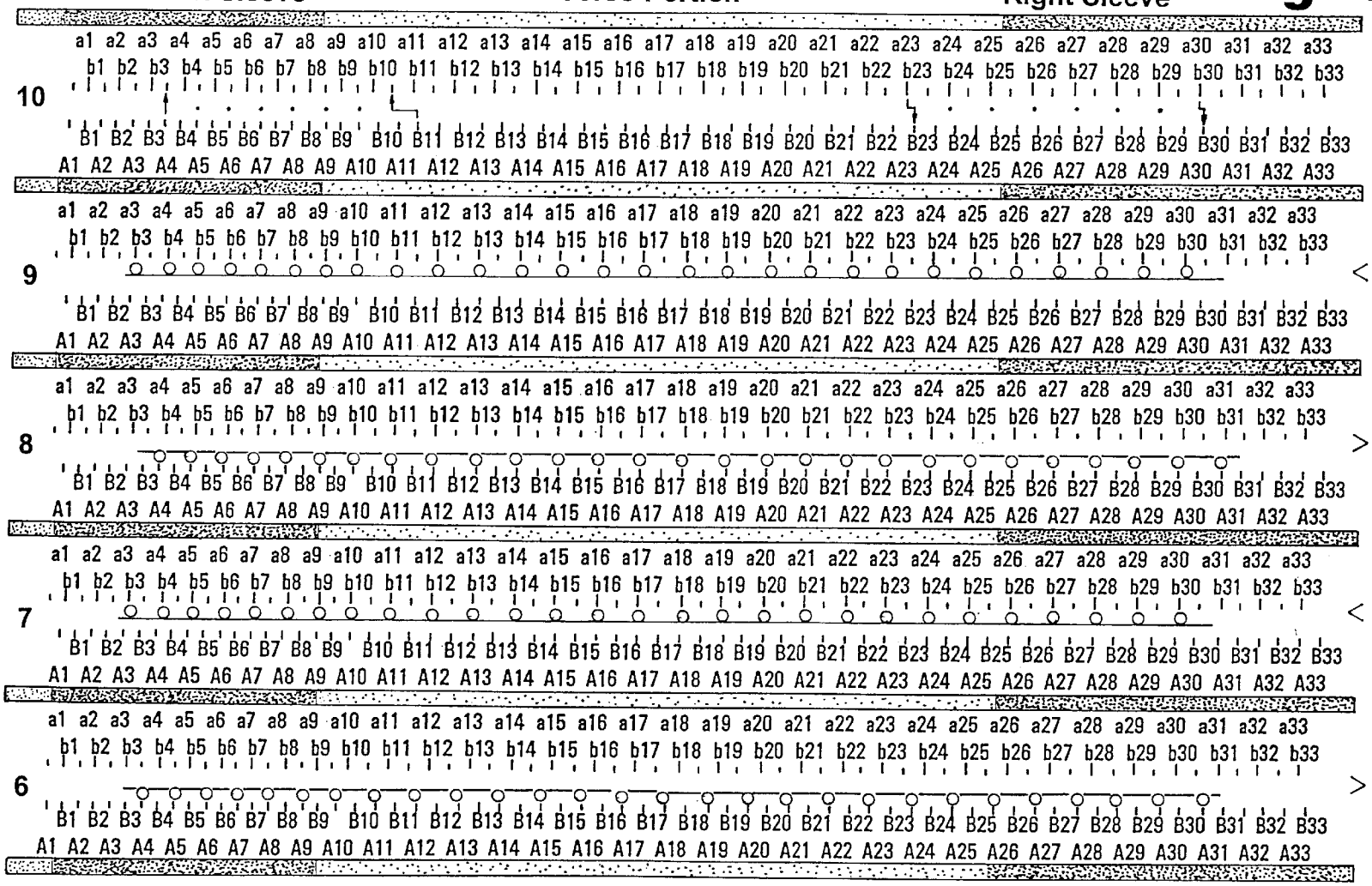
Fig. 4.2

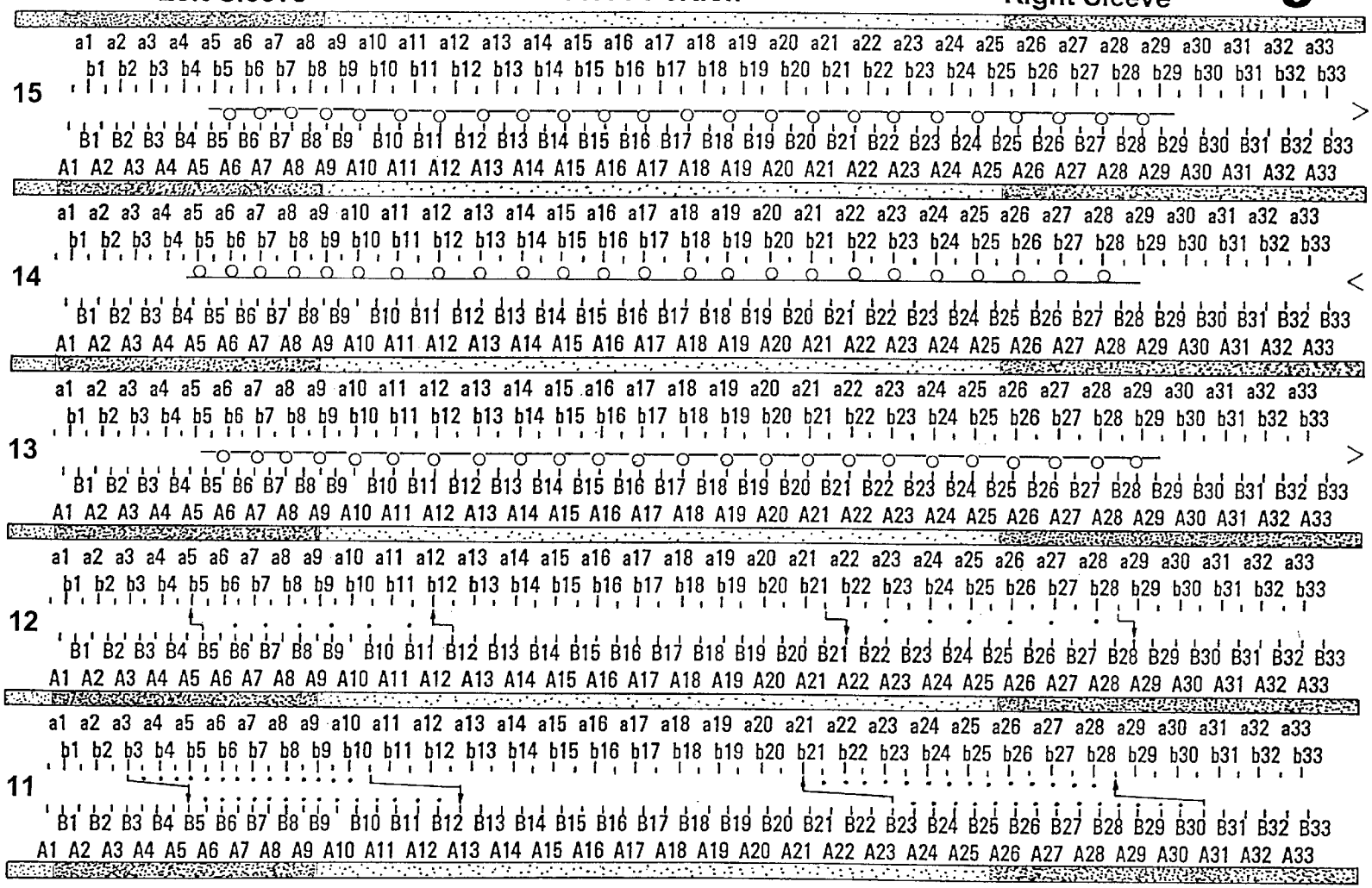
Fig. 4.3

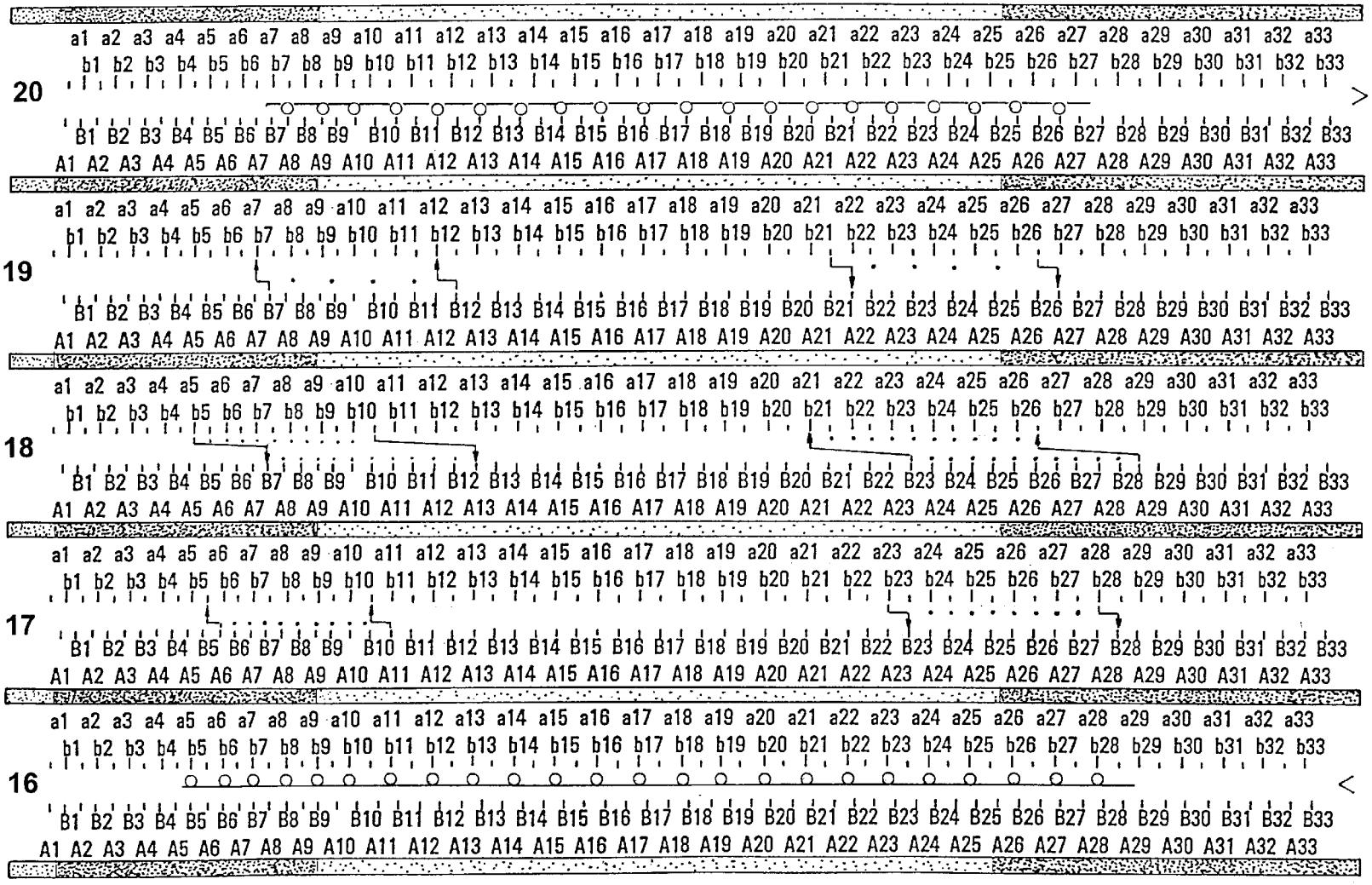
Fig. 4.4

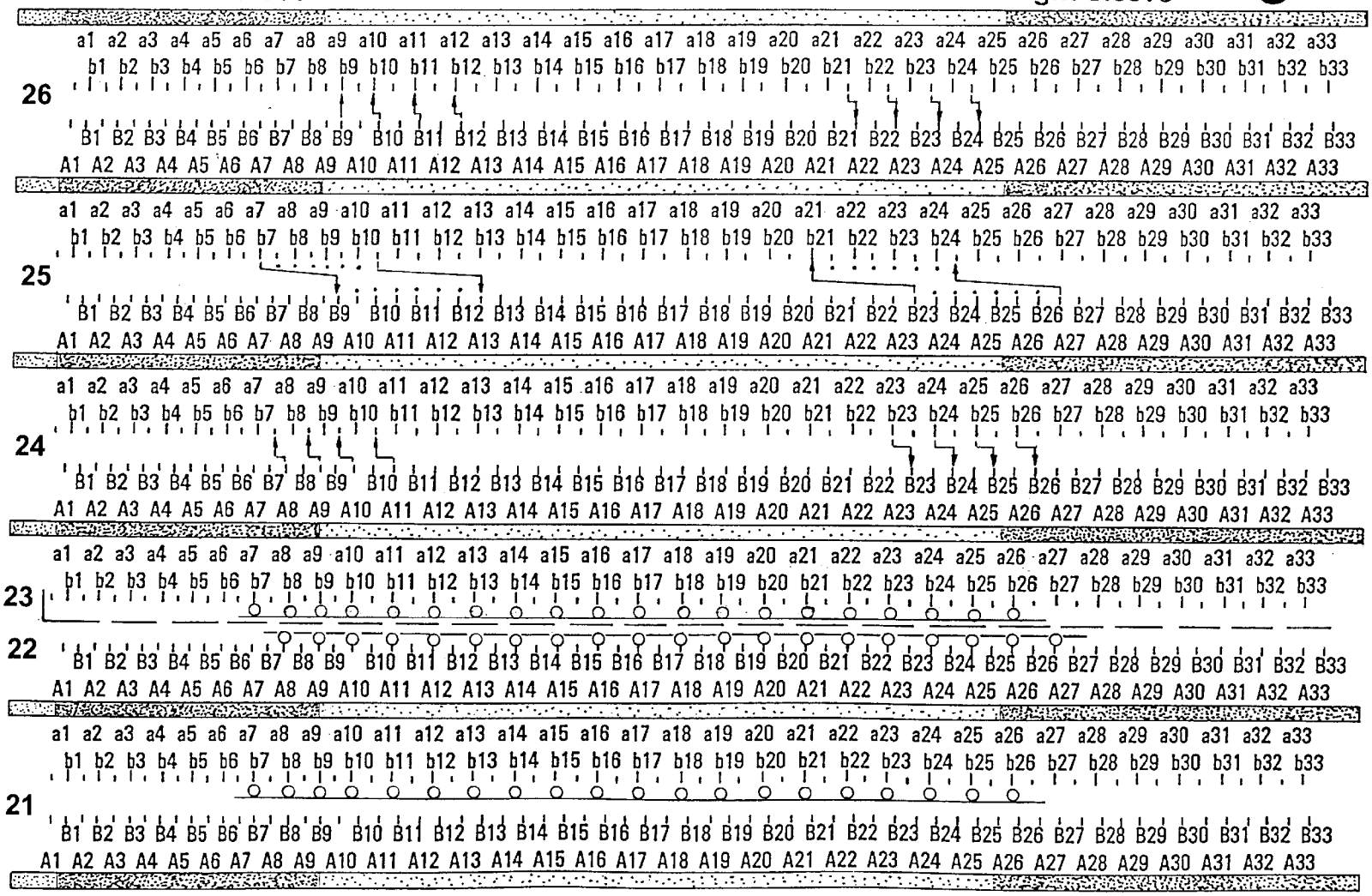
Fig. 4.5

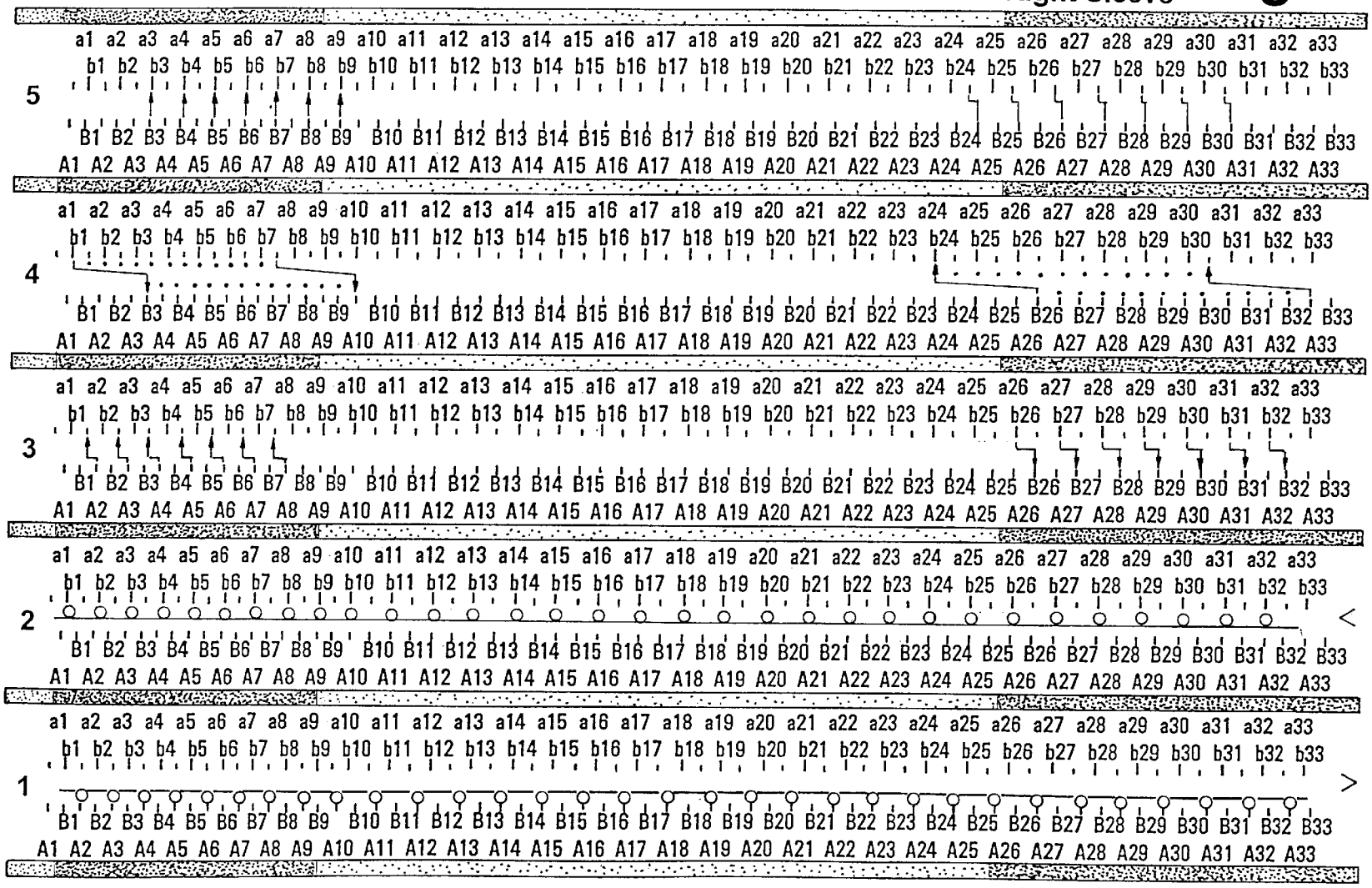
Fig. 6.1

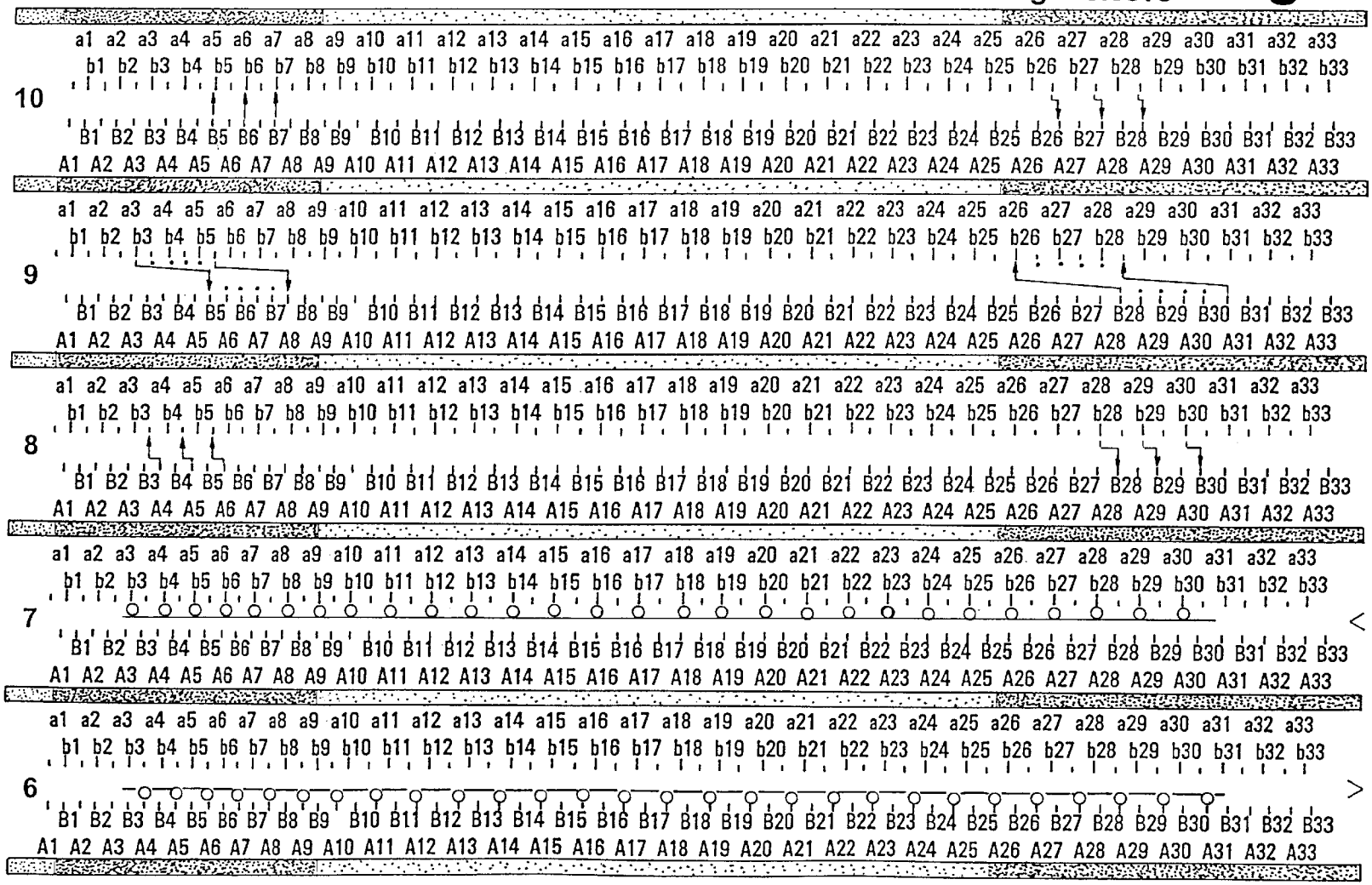
Fig. 6.2

PROCESS FOR PRODUCING SLEEVED CLOTHING ARTICLES ON A TWO BED FLAT KNITTING MACHINE

BACKGROUND OF THE INVENTION

The present invention relates to a process for producing sleeved clothing articles on a two bed flat knitting machine and, more particularly, to a process for producing sleeved clothing articles on a two bed flat knitting machine wherein the clothing article is a complete knitted article.

A clothing article producable on a flat knitting machine can be produced with sleeves and a torso portion by initially using different yarn guides for the sleeves and the torso portion to produce tubular knits for these clothing article components and then, subsequently, to connect these components to one another to make an integral single piece article. There are various possibilities for the formation of the sleeves and the sleeve formation process significantly impact the look of the finished clothing article.

SUMMARY OF THE INVENTION

The present invention provides three variations of a process for for interconnecting the sleeves and the torso portion of a sleeved clothing article during production of the sleeved clothing article on a two bed flat bed knitting machine. One variation of the process provides sleeves having seam regions extending perpendicularly to the shoulders; another variation provides sleeves having seam regions extending at an angle to the shoulders; and a further variation provides raglan sleeves.

The three variations of the process of the present invention commonly share the characteristic that the sleeved clothing article is of the type in which the two sleeves and the torso portion are finished as tubular knits with separated yarn guides and the stitches are disposed on the needle beds of the flat knitting machine such that the needles of one respective needle bed are not occupied when the needles of the other needle bed are occupied with stitches.

The advantage of the process of the present invention is a reduction in the number of yarn suspending steps necessitated by the stitch lessening requirements as compared with known processes.

BRIEF DESCRIPTION OF THE DRAWINGS

FIGS. 2.1–2.3 is a schematic representation of the knitting sequence for creating the seam regions interconnecting the sleeves with the torso portion of the pullover shown in FIG. 1;

FIGS. 4.1–4.5 is a schematic representation of the knitting sequence for creating the seam regions interconnecting the sleeves with the torso portion of the pullover shown in FIG. 3;

FIGS. 6.1 and 6.2 is a schematic representation of the knitting sequence for creating a seam region of the pullover shown in FIG. 5 interconnecting the sleeves with the torso portion thereof.

DESCRIPTION OF THE PREFERRED EMBODIMENTS

Figure 1:
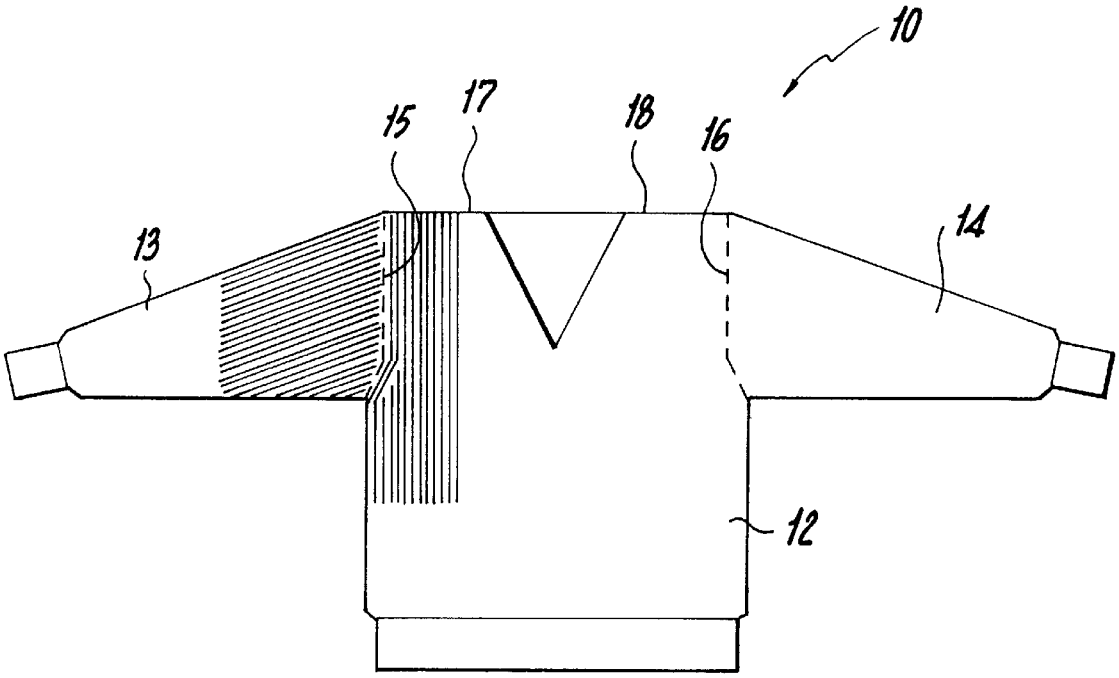
FIG. 1 is a schematic front plan view of a pullover having respective seam regions perpendicular to the shoulder interconnecting the sleeves and the torso portion of the pullover.

As seen in FIG. 1, a pullover 10 has a torso portion 12 and a pair of sleeves 13 and 14. A seam region 15 and 16 interconnects the sleeves 13 and 14, respectively, and the torso portion 12 and is indicated by a broken line extending generally perpendicularly to the shoulders 17 and 18 of the pullover 10.

FIG. 2 schematically shows the knitting sequence accomplished by a flat knitting machine in creating the seam 15 and 16 between the sleeves 13 and 14 and the torso portion 12 in accordance with one variation of the process of the present invention. The areas for the needle beds for the left and right sleeves are shown as the darker shaded areas and the needle area for the torso portion is shown as the relatively lighter shaded areas. All stitch rows on the front and rear needle beds are knitted with the same yarn guide. The relationship of the knitted rows of the torso portion to the knitted rows of the sleeves is 2:1. This relationship can be varied without departing from the scope of the process of the present invention.

In row 1, a stitch row is knitted by a first knitting system in a carriage or shuttle direction from right to left with the needles b25–b1 of the rear needle bed in the region of both sleeves and the torso portion. In row 2, the stitches of the right sleeve on the needles b25–b21 of the rear needle bed are transferred to the needles B25–B21 of the front needle bed and the stitches of the left sleeve on the needles A5–A1 of the front needle bed are transferred to the needles a5–a1 of the rear needle bed.

In row 3, via a needle exchange, the following needles of the front needle bed are transferred to needles of the rear needle bed: B25–B21 to b22–8 and the following stitches on the needles in the rear needle bed are transferred to needles in the front needle bed: a1–a5 to A4–A8. Thereafter, after a return movement of the needles, in row 4, the stitches of the needles a19–a22 on the needles A19–A22 of the rear needle bed are transferred to the front needle bed and the stitches of the needles B4–B7 of the front needle bed are transferred to the needles b4–b7 of the rear needle bed. In this manner, the cover- and lessening steps of shaping the sleeves into interconnection with the torso portion is completed.

In row 5, in a carriage or shuttle direction from left to right, a stitch row is created with the needles A4–A21 on the front needle bed in the area of the left sleeve and the torso portion. Thereafter, in row 6, in a reverse carriage or shuttle direction, a stitch row is created with the needles A21–A6 of the front needle bed in the area of the torso portion and in row 7. in a carriage or shuttle direction from left to right and with the needles A6–A22 again on the front needle bed in the area of the torso portion and the right sleeve. In row 8, in reverse carriage or shuttle direction and with the needles b22–b6 on the rear needle bed in the area of the right sleeve and the entire torso portion, a stitch row is built. Thereafter, in row 9, in a carriage or shuttle direction from left to right and with the needles b6–b20 in the area of the torso portion, a stitch row is created on the rear needle bed. Subsequently, in row 10, in a carriage or shuttle direction from right to left and with the needles b20–b4 in the area of the torso portion and the left sleeve, a stitch row is created on the rear needle bed. In row 11, in a carriage or shuttle direction from left to right and with the needles A4–A22 in the area of both sleeves and the torso portion, a stitch row is built on the front needle bed. The just described steps can be repeated until the torso portion is completed and the sleeves are completely stitched in with the torso portion.

Figure 3:
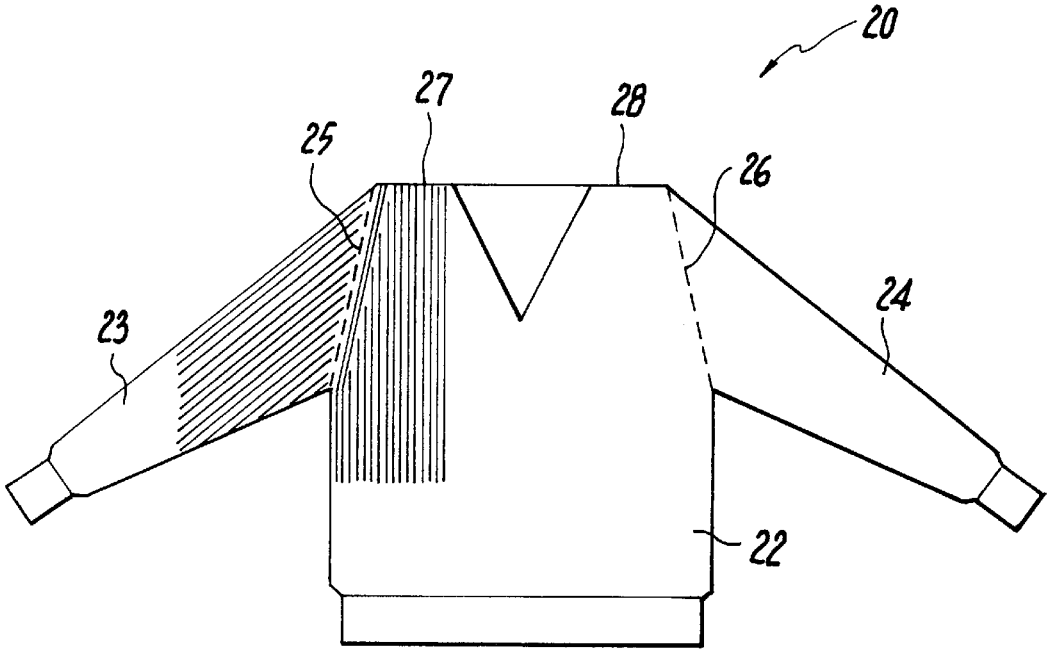
FIG. 3 is a schematic view of a pullover having respective seam regions extending at an angle to the shoulder and interconnecting the sleeves and the torso portion of the pullover.

FIG. 3 shows another pullover 20 having a torso portion 22 and two sleeves 23 and 24, whereby the seam regions 25 and 26 between the sleeves 23 and 24 and the torso portion 22 extends at an angle or slant to the shoulders 27 and 28 of the pullover 20.

FIG. 4 schematically shows the knitting sequence for a flat knitting machine to create the pullover 20 in accordance with another variation of the process of the present invention. Again, all of the stitch rows on the front and rear needle beds are knitted with the same yarn guide. The shaping of tubular knits on the torso portion and the thereon hanging sleeves is achieved through a lessening step process. In the rows 3–5, a lessening step process of the torso portion is executed and a lessening step process is executed in the rows 10–12, 17–19, and 24 and 26. The count of knitted stitch rows in between the lessening steps can vary as a function of the shaping of the pullover; the same is true for the count of the per step lessened stitches, as the slant of the seam between the torso portion and the sleeves is a function of this. In the example illustrated in FIG. 4, the relationship between the count of the torso portion lessening to the count of the sleeve lessening is 1:3. The higher the count of the sleeve lessening, the steeper the seam between the sleeves and the torso portion.

In row 1, a stitch row is created on the front needle bed by a first knit system in a carriage or shuttle direction from left to right with the needles A2–A33 and, subsequently, in row 2, in reverse carriage or shuttle direction and with the needles b32–b1 on the rear needle bed, a stitch row is created. To lessen the stitch count of the torso portion, in row 3, the stitches A2–A13 are suspended from the front needle bed to the rear needle bed and the stitches b21–b32 on the rear needle bed are suspended to the front needle bed. In row 4, after a needle bed movement, all of the stitches suspended on the rear needle bed in the area of the needles b1–b12 and a2–a13 are suspended to the needles B3–B13 and A4–A15. Additionally, all of the stitches on the front needle bed in the area of the needles B21–B32 and A22–A33 are suspended to the needles b19–b30 and a20–a31 of the rear needle bed. After a return movement of the needle beds, the stitches associated with the back portion of the tubular knit are suspended from the needles B3–B14 on the front needle bed to the needles b3–b14 of the rear needle bed and the stitches associated with the front portion of the tubular knit are suspended from the needles A22–A31 of the rear needle bed to the needles A22–A31 of the front needle bed. In this manner, the lessening process for the torso portion is completed.

Thereafter, two stitch rows are knitted in each of the rows 6–9 on the front needle bed with the needles A4–A31 and on the rear needle bed with the needles b3–b30. Subsequently, the lessening process for both sleeves commences starting from row 10. In this context, the stitches A4–A11 of the front needle bed are suspended to the needles a4–a11 in the rear needle bed and the stitches on the needles b23–b30 of the rear needle bed are suspended on the needles B23–B30 of the front needle bed. In row 11, after a needle bed movement, the stitches of the needles b3–b10 and a4–a11 of the rear needle bed are suspended to the needles B5–B12 and A6–A13 of the front needle bed. Additionally, the stitches on the needles B23–B30 and A24–A31 of the front needle bed are transferred to the needles b21–b28 and a22–a29 of the rear needle bed. In row 12, the stitches associated with the back portion of the knit are suspended from the needle B5–B12 of the front needle bed to the needles b5–b12 of the rear needle bed and the stitches associated with the front portion of the knit are suspended from the needles a22–a29 of the rear needle bed to the needles A22–A29 of the front needle bed.

In rows 13–16, two stitch rows are created in each row with the needle A6–A29 of the front needle bed and the needles b5–b28 of the rear needle bed. In this manner, the stitches of the needles A6–A11 of the front needle bed are suspended to the needles a6–a11 of the rear needle bed and the stitches on the needles b23–b28 of the rear needle bed are suspended to the needles B23–B28 of the front needle bed. Thereafter, in row 18, following a needle bed movement, the stitches on the needles b5–b10 and a6–a11 of the rear needle bed are suspended to the needles B7–B12 and A8–A13 of the front needle bed and the stitches of the needles B23–B28 and A24–A29 of the front needle bed are suspended to the needles b21–b26 and a22–a27.

Subsequently, there follows in row 19 a re-suspension of the back portion stitches on the needles 137–1312 of the front needle bed to the needles b7–b12 of the rear needle bed as well as a re-suspension of the stitches associated with the front portion from the needles a22–a27 of the rear needle bed to the needles A22–A27 of the front needle bed. In rows 20–23, two stitch rows are created on each of the rows on the needles A8–A27 of the front needle bed and needles b7–b26 of the rear needle bed. Thereafter, a lessening process is executed in the rows 24–26 for the sleeves. In this connection, in row 24, the stitches on the needles A8–A11 of the front needle bed are suspended to the needles a8–a11 of the rear needle bed and the stitches of the needles b23–b26 of the rear needle bed are suspended to the needles B23–B26 of the front needle bed. In row 25, after a needle bed movement, the stitches on the needles b7–b10 and a8–a11 of the rear needle bed are suspended on the needles B9–B12 and A10–A13 of the front needle bed. Additionally, the stitches on the needles B23–B26 and A24–A27 of the front needle bed are suspended on the needles b21–b24 and a22–a25. Thereafter, there follows in row 26 a re-suspension of the back portion stitches on the needles B9–B12 of the front needle bed to the needless b9–b12 of the rear needle bed and a re-suspension of the front portion stitches on the needles a22–a25 of the rear needle bed to the needles A22–A25 of the front needle bed. Subsequently, the steps for the rows 1–26 can be repeated until the sleeve has been completely knitted together with the torso portion.

Figure 5:
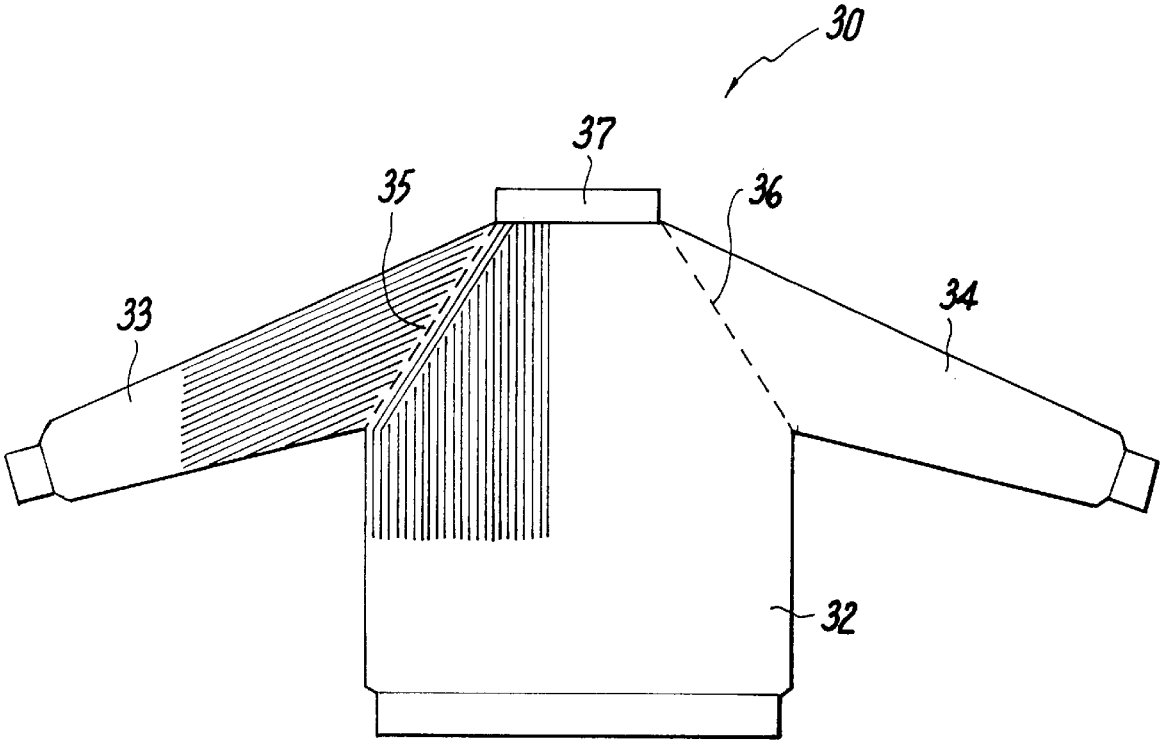
FIG. 5 is a schematic view of a pullover having raglan sleeves.

FIG. 5 shows a pullover 30 knitted in accordance with a further variation of the process of the present invention and having a torso portion 32 and two raglan sleeves 33 and 34. The seam regions 35 and 36 of the sleeves 33 and 34 extend at a slant from the sleeve undersides to the collar portion 37 of the pullover 30. A knit process to produce such a raglan seam 35 or 36 is shown in FIG. 6. The seam connection is again achieved through a lessening process on the torso portion and the sleeves. In the rows 3–5 there is executed a lessening of the stitch count of the torso portion and, in rows 8–10, a lessening of the stitch count of the sleeves. The rows in between the knitted lessened rows can vary in count as a function of the tailoring of the pullover. The same is true for the count of the per step lessened stitches. The greater the difference in the count of the lessened stitches between the torso portion and the sleeves, the wider is then the lessened area.

In row 1, a stitch row is created over both sleeves and the torso portion on the front needle bed by a first knit system in a carriage or shuttle direction from left to right with the needles A2–A33. Thereafter, in row 2, in reverse carriage or shuttle direction, a stitch row with both sleeves and the torso portion is created with the needles b32–b1 on the rear needle bed. Also, in row 3, stitches on the needles A2–A8 of the front needle bed are suspended to the needles a2–a8 of the rear needle bed by a further knit system and stitches on the needles b26–b32 of the rear needle bed are suspended to the needles B26–B32 of the front needle bed. In row 4, after a needle bed movement, the stitches on the needles b1–b7 and a2–a8 of the rear needle bed are suspended to the needles B3–B9 and A4–A10 of the front needle bed. Also, the stitches B26–B32 and A27–A33 of the front needle bed are suspended on the needles b24–b30 and a25–a31 of the rear needle bed. There then follows, in row 5, a re-suspension of the stitches B3–B9 of the front needle bed to the needles b3–b9 of the rear needle bed and a suspension of the needles a25–a31 of the rear needle bed to the needles A25–A31 of the front needle bed.

Following this lessening of the torso portion, a stitch row is created in each of the rows 6 and 7 with the needles A4–A31 of the front needle bed and with the needles b3–b30 of the rear needle bed for, respectively, each of the sleeves and the torso portion. Thereafter, in row 8, to lessen the sleeves, the stitches of the needles A4–A6 of the front needle bed are suspended to the needles a4–a6 of the rear needle bed and the stitches on the needles b28–b30 of the rear needle bed are suspended to the needles B28–B30 of the front needle bed. Subsequently, in row 9, after a needle bed movement, the stitches of the needles b3–b5 and a4–a6 are suspended to the needles B5–B7 and A6–A8 of the front needle bed and the stitches of the needles B28–B30 and A29–A31 are suspended to the needles b26–b28 and a27–a29 of the rear needle bed. In row 10, there follows a re-suspension of the stitches of the needles B5–B7 of the front needle bed to the needles b5–b7 of the rear needle bed and of the stitches on the needles a27–a29 of the rear needle bed to the needles A27–A29 of the front needle bed. The steps 1–10 can be repeated until the sleeve is completely knitted together with the torso portion.

We claim:

1. A process for interconnecting sleeves and a torso portion of a sleeved clothing article during production of the sleeved clothing article on a two bed flat bed knitting machine, the sleeved clothing article having a pair of seam regions (15, 16) interconnecting, respectively, a pair of sleeves (13,14) and a torso portion (12) and extending generally perpendicularly from respective shoulders (17,18) of clothing article and in which the two sleeves (13,14) and torso portion (12) are initially finished as tubular knits with separated yarn guides and the stitches being disposed on the needle beds of flat knitting machine such that needles of one respective needle bed are not occupied when needles of the other needle bed are occupied with stitches, comprising:

a) creating, in a first carriage direction, a stitch row for both sleeves and the torso portion on the rear needle bed of the flat knitting machine;

b) introducing a lessening process including suspending the stitches (b21–b25) of a back portion of the right sleeve in the opposing, unoccupied needles (B21–B25) of the front needle bed and transferring the stitches of a front portion of the left sleeve (A1–A5) from the front needle bed onto the opposing rear needle bed;

c) racking one of the needle beds and transferring the stitches (A22–A25, B21–B25) of the right sleeve from the front needle bed onto the opposing needles of the rear needle bed in the area of the torso portion and onto the unoccupied needles (b21 and b22, a22) in the area of the right sleeve and transferring the stitches (a1–a5, b1–b4) of the left sleeve on the rear needle bed onto the needles (A6–A8, B6 and B7) of the front needle bed in the area of the torso portion and onto the unoccupied needles (A4 and A5, B4 and B5) in the area of the left sleeve;

d) after a return movement of the needle beds to the end position, re-suspending the stitches (B4–B7) of the back portion of the left sleeve and the left border area of the torso portion from the front needle bed onto the rear needle bed and the stitches (a19–a22) of the front portion of the right sleeve and the right border area of the torso portion from the rear needle bed onto the front needle bed;

e) knitting at least one stitch row on the front needle bed in the area of the torso portion and both sleeves;

f) knitting at least one stitch row on the front needle bed in the area of the torso portion;

g) knitting at least one stitch row on the rear needle bed in the area of both sleeves and the torso portion;

h) knitting at least one stitch row on the rear needle bed in the area of the torso portion; and i) repeating the steps a)–h) until both sleeves are knitted together with the torso portion.

2. A process for interconnecting sleeves (23,24) and a torso portion (22) of a sleeved clothing article during production of the sleeved clothing article on a two bed flat bed knitting machine, the sleeved clothing article having a pair of seam regions (25,26) interconnecting, respectively, a pair of sleeves (23,24) and a torso portion (22) and extending at an angle from respective shoulders (27,28) of the clothing article and in which the two sleeves (23,24) and the torso portion (22) are initially finished as tubular knits with separated yarn guides and the stitches being disposed on the needle beds of the flat knitting machine such that the needles of one respective needle bed are not occupied when the needles of the other needle bed are occupied with stitches, comprising:

a) knitting in a first carriage direction a stitch row on the front needle bed in the area of both sleeves and the torso portion and thereafter knitting in an opposite carriage direction a stitch row on the rear needle bed in the area of both sleeves and the torso portion;

b) to lessen the stitch count of the torso portion, transferring the stitches (A2–A13) of a front portion of the left sleeve and the stitches in a left border area of the torso portion from the front needle bed to the rear needle bed and transferring the stitches (b21–b32) of a back portion of the right sleeve and the stitches of a right border area of the torso portion from the rear needle bed to the front needle bed;

c) after a needle bed racking, suspending all stitches (b1–b12, a2–a13) in the area of the left sleeve and the left border of the torso portion from the rear needle bed to the front needle bed and all stitches (B21–B32, A22–A33) in the area of the right sleeve and the right border area of the torso portion from the front needle bed to the rear needle bed;

d) after a return movement of the needle beds, re-suspending the stitches (B3–B14) of the back portion of the left sleeve and of the left border area of the torso portion from the front needle bed to the rear needle bed and the stitches (a22–a31 of the front portion of the right sleeve and the right border area of the torso portion from the rear needle bed to the front needle bed;

e) knitting at least one stitch row on each of the front and rear needle beds in the area of both sleeve and the lessened torso portion;

f) to lessen the stitch count of the sleeves, suspending the stitches (A4–A11) of the front portion of the left sleeve from the front needle bed to the rear needle bed and suspending the stitches (b23–b30) of the back portion of the right sleeve from the rear needle bed to the front needle bed;

g) after a needle bed movement, suspending all stitches of the left and right sleeve (b3–b10, a4–a11; B23–B30, A24–A31) from the respective front needle bed and rear needle bed to the other respective front needle bed and rear needle bed;

h) after a return needle bed movement, re-suspending the stitches (B5–B12) of the back portion of the left sleeve and the left border area of the torso portion from the front needle bed to the rear needle bed and re-suspending the stitches (a22–a29) of the front portion of the right sleeve and the right border area of the torso portion from the rear needle bed to the front needle bed;

i) repeating the steps e)–h) before thereafter repeating the steps b)–d) to lessen the stitch count of the torso portion; and j) repeating steps b)–i) until the sleeves are completely knitted together with the torso portion.

3. A process for interconnecting raglan sleeves (33,34) and a torso portion (32) of a sleeved clothing article during production of the sleeved clothing article on a two bed flat bed knitting machine, the sleeved clothing article having the two sleeves and the torso portion finished as tubular knits with separated yarn guides and the stitches being disposed on the needle beds of the flat knitting machine such that the needles of one respective needle bed are not occupied when the needles of the other needle bed are occupied with stitches, comprising:

a) knitting a respective stitch row on each of the front and rear needle beds of the flat knitting machine in the area of both sleeves and the torso portion;

b) to lessen the stitch count of the torso portion, suspending the stitches of a front portion of the left sleeve (A2–A6) and of a left border area of the torso portion (A7, A8) from the front needle bed to the rear needle bed and suspending the stitches of a back portion of the right sleeve (b28–b32) and a right border area of the torso portion (b26,b27) from the front needle bed to the rear needle bed;

c) after a needle bed racking, suspending all stitches (b1–b7, a2–a8) in the area of the left sleeve and of the left border area of the torso portion from the rear needle bed to the front needle bed and all stitches (B26–B32, A27–A33) of the right sleeve and of the right border area of the torso portion from the front needle bed to the rear needle bed;

d) after a return movement of the needle beds, re-suspending the stitches (B3–B9) of the back portion of the left sleeve and the left border area of the torso portion from the front needle bed to the rear needle bed and re-suspending the stitches (a25–a31) of the front portion of the right sleeve and of the right border area of the torso portion from the rear needle bed to the front needle bed;

e) knitting at least one stitch row on the front and rear needle beds in the area of both sleeves and the torso portion;

f) to lessen the stitch count of the sleeves, suspending the stitches (A4–A6) of the front portion of the left sleeve from the front needle bed to the rear needle bed and suspending the stitches (28–b30) of the back portion of the right sleeve from the rear needle bed to the front needle bed;

g) after a needle bed racking, suspending all stitches (b3–b5, a4–a6) in the area of the left sleeve from the rear needle bed to the front needle bed and all stitches (B28–B30, A29–A31) in the area of the right sleeve from the front needle bed to the rear needle bed;

h) after a return movement of the needle beds, re-suspending the stitches (B5–B7) of the back portion of the left sleeve and of the left border area of the torso portion from the front needle bed to the rear needle bed and the stitches (a27–a29) of the front portion of the right sleeve and of the right border area of the torso portion from the rear needle bed to the front needle bed; and i) repeating steps b)–h) until the sleeves have been completely knitted together with the torso portion.

* * * * *